US007813693B2

(12) United States Patent
Ueng

(10) Patent No.: US 7,813,693 B2
(45) Date of Patent: Oct. 12, 2010

(54) PRINT MEDIA PREHEATING SYSTEM AND METHOD OF USE

(75) Inventor: Su-wen Ueng, Wilsonville, OR (US)

(73) Assignee: Xerox Corporation, Norwalk, CT (US)

( * ) Notice: Subject to any disclaimer, the term of this patent is extended or adjusted under 35 U.S.C. 154(b) by 1048 days.

(21) Appl. No.: 11/152,494

(22) Filed: Jun. 13, 2005

(65) Prior Publication Data

US 2006/0280535 A1 Dec. 14, 2006

(51) Int. Cl.
*G03G 15/00* (2006.01)

(52) U.S. Cl. ..... 399/390; 399/400; 399/406; 399/328; 101/487; 101/488; 347/102; 347/155; 347/156; 347/185; 347/186; 347/187

(58) Field of Classification Search ..... 399/390, 399/400, 401, 328; 347/102, 17, 155, 156, 347/186, 187, 185; 101/487, 488
See application file for complete search history.

(56) References Cited

U.S. PATENT DOCUMENTS 4,746,952 A * 5/1988 Kusuda et al. ..... 399/229
5,300,952 A * 4/1994 Wada et al. ..... 347/217
5,499,876 A * 3/1996 Hosokawa et al. ..... 400/56
5,757,387 A * 5/1998 Manduley ..... 347/2
5,774,204 A * 6/1998 Suzuki et al. ..... 355/27
5,839,038 A 11/1998 Kopp et al.
5,974,298 A 10/1999 Urban et al.

FOREIGN PATENT DOCUMENTS

| | | |
|---|---|---|
| GB | 2 270 501 | 3/1994 |
| JP | 61 255372 | 11/1986 |
| JP | 2000-072340 A | 3/2000 |
| JP | 2004-333701 A | 11/2004 |

* cited by examiner

*Primary Examiner*—Ren Yan
*Assistant Examiner*—Matthew G Marini
(74) *Attorney, Agent, or Firm*—Marger Johnson & McCollom P.C.

(57) ABSTRACT

A print media preheating system and method of preheating print media that includes an upper heating plate that is arranged to heat a pre-printed side of the print media with a pressure of the upper heating plate on the print media being relieved by lifting the upper heating plate away from the print media so as to reduce smudging of ink printed on the pre-printed side of the print media.

11 Claims, 5 Drawing Sheets

PRINT MEDIA PREHEATING SYSTEM AND METHOD OF USE

TECHNICAL FIELD

This disclosure is related to the preheating of print media and more particularly to the preheating of duplex print media.

BACKGROUND OF THE DISCLOSURE

In solid ink printing technology, the print media is preheated by a preheater system in order to improve adhesion of the ink to the print media during the printing process. Drum maintenance oil is also applied to the printer drum to provide better transfer of the ink to the print media. The preheat temperature of the print media and the type of drum maintenance oil are factors that can affect print quality. A higher preheat temperature and a lower viscosity of drum maintenance oil can result in better ink adhesion to the print media.

In duplex printing (printing on both sides of the same piece of print media, e.g., a sheet of paper), the print media has simplex and duplex sides. The simplex side of the print media is the side printed first. The duplex side of the print media is printed second. In duplex printing, the print media is routed back to the preheater after printing on the simplex side. The print media is then fed through the preheater and onto the printing drum oriented so that the duplex side is printed.

When the print media is fed back to the preheater after printing on the simplex side, the ink on the simplex side can smudge as a result of many factors. These factors include a high preheat temperature, low viscosity of drum maintenance oil and pressure on the print media from the heating plates in the preheater. The smudging leaves streaks of ink on the simplex side of the duplex printed print media.

SUMMARY OF THE DISCLOSURE

According to embodiments illustrated herein, there is provided a print media preheater that includes an upper heating plate arranged to heat a previously printed side of print media. The upper heating plate includes a hook on an upper surface of the upper heating plate, to which hook a lever is pivotably connected. The lever is structured to relieve a pressure on the print media by the upper heating plate by lifting the upper heating plate.

Further provided is a print media preheating system that includes an upper and lower heating plate positioned to preheat print media fed between the upper and lower heating plates. The system further includes a means for relieving a pressure from the upper heating plate on the print media.

Further provided is a method of preheating print media for duplex printing that includes feeding print media having a pre-printed side between upper and lower heating plates with the pre-printed side facing the upper heating plate. The method includes setting a temperature in the upper and lower heating plates that is above a smudging temperature of ink. The method further includes lifting the upper heating plate away from the print media.

DETAILED DESCRIPTION

Figure 1:
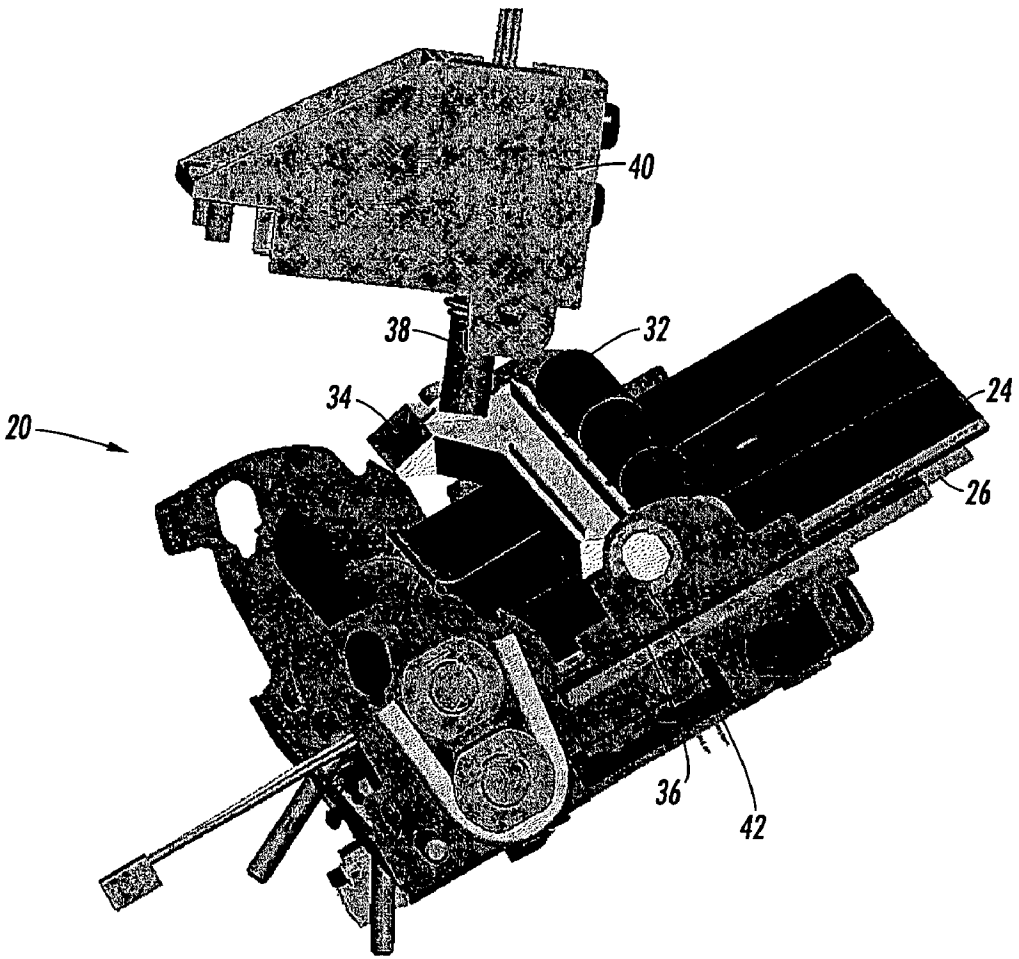
FIG. 1 is a perspective view of a print media preheating system according to an embodiment of the invention.
Figure 5:
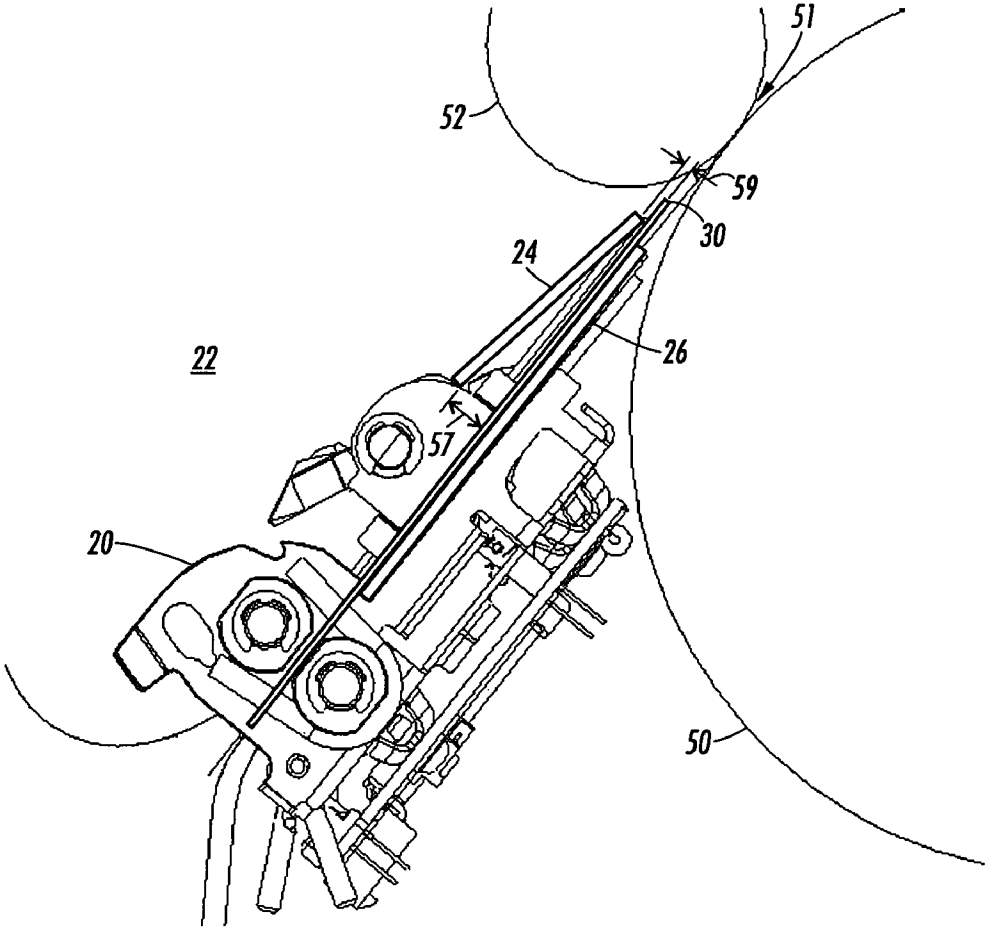
FIG. 5 is a side elevation view of the upper and lower heating plates of the print media preheating system of FIG. 1 showing the rest of the preheating system and printing drum and transfix roller in phantom line.

FIG. 1 is a perspective view of the print media preheating system 20 according to an embodiment of the invention arranged for use in a printer 22 (see FIG. 5). The word "printer" as used herein encompasses any apparatus, such as digital copier, bookmaking machine, facsimile machine, multi-function machine, etc. which performs a print outputting function for any purpose. The words "print media" as used herein encompasses any kind of media used in such printers, including flexible sheets of paper, cardboard, plastic, transparency stock and the like which are compatible with heating and imprinting ink.

The print media preheater 20 includes upper heating plates 24 and lower heating plate 26. The upper and lower heating plates 24, 26 are heated by the preheater 20 which allows the plates 24, 26 to preheat print media 30 (see FIG. 5) fed between the plates 24, 26.

The upper heating plates 24 are arranged within the preheater 20 to heat the non-printing side of the print media. When duplex printing is occurring, the upper heating plates heat the simplex side of the print media.

The upper plates 24 include hook 32 onto which the lever arm bracket 34 pivotably connects. The lever arm bracket 34 is rotatably connected to the preheater frame 36 at pivot connection 42. Responsive to a signal sent to the solenoid 40, plunger 38 is extended from solenoid 40 to contact the lever arm bracket 34. As the plunger 38 extends from the solenoid 40, the plunger 38 rotates the lever arm bracket 34 around the pivot connection 42 which raises hook features 44 on the lever arm bracket (see FIG. 2). The rising hook features 44 pivotably lift or rock the upper plates 24 away from the print media 30 and thus relieve a pressure downward on the print media 30 caused by the weight of the upper heating plates 24.

In the embodiment shown in FIG. 1, gravity provides a means for biasing the upper plates 24 to press against the print media 30. In FIG. 1, because gravity provides the biasing force, the lever arm bracket 34 is structured to lift the upper heating plates 24 responsive to the plunger 38 from solenoid 40 pressing on a contact point of the lever arm bracket 34. When the plunger 38 is retracted into the solenoid 40, the weight of the upper heating plates 24 under gravity drops the upper heating plates 24 back down against the lower heating plate 26.

If biasing force other than gravity is used, such as a spring in side-by-side arrangement of heating plates, the term "lower" in reference to the lower heating plate 26 can more broadly mean a heating plate that remains in a fixed position, with the term "upper" in reference to the upper heating plates 24 meaning heating plates that are movable.

By relieving a pressure from the upper heating plates 24 on the print media 30, the heating plates 24, 26 can be heated to a temperature that is higher than an ink smudging temperature. The pressure relief also leads to the use of a wider range of drum maintenance oil and a wider range of inks with different temperature sensitivities.

Figure 2:
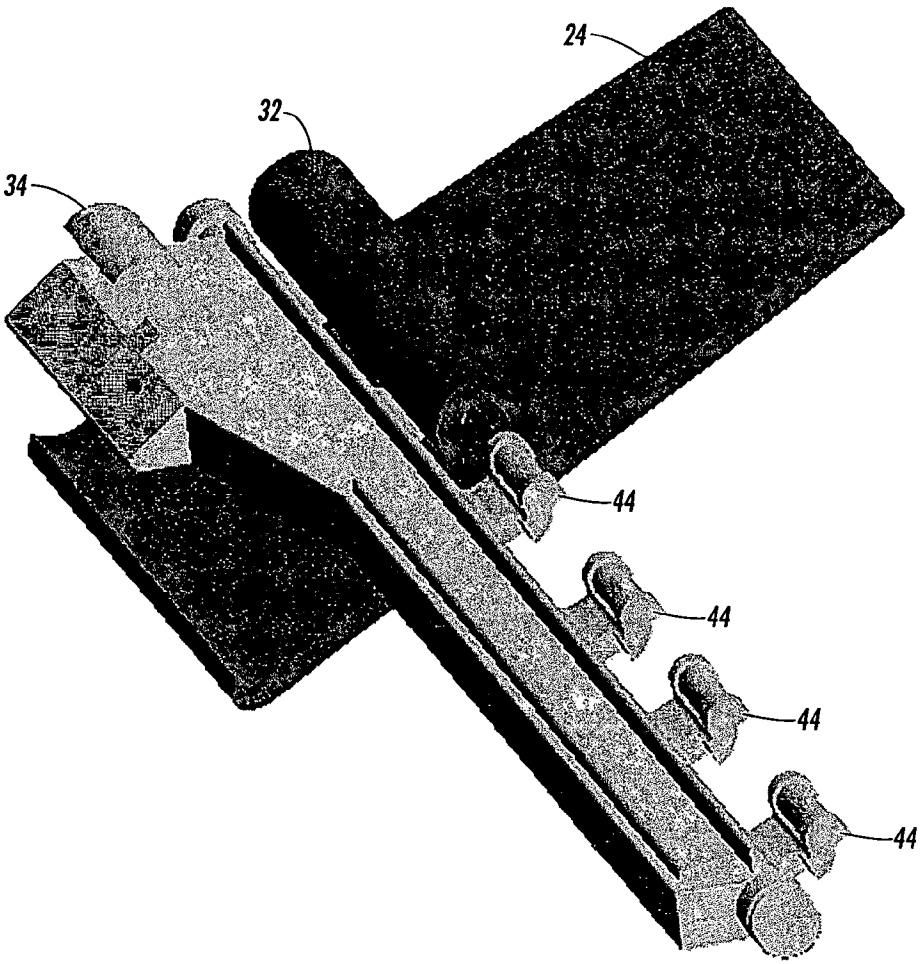
FIG. 2 is a perspective view of the lever arm and a portion of an upper heating plate of the print media preheating system of FIG. 1.

FIG. 2 shows a perspective view of the lever arm bracket 34 pivotably connected to one of the upper heating plates 24.

Lever arm bracket 34 includes hook features 44 that are shaped and arranged to pivotably connect with the hook 32 of each upper heating plate 24. Because the lever arm bracket 34 must withstand the preheating temperatures of the preheater 20, the bracket 34 can be made of a material including a glass and mineral filled plastic having low deflection and low creep characteristics at a temperatures of about 110° C.

Figure 3:
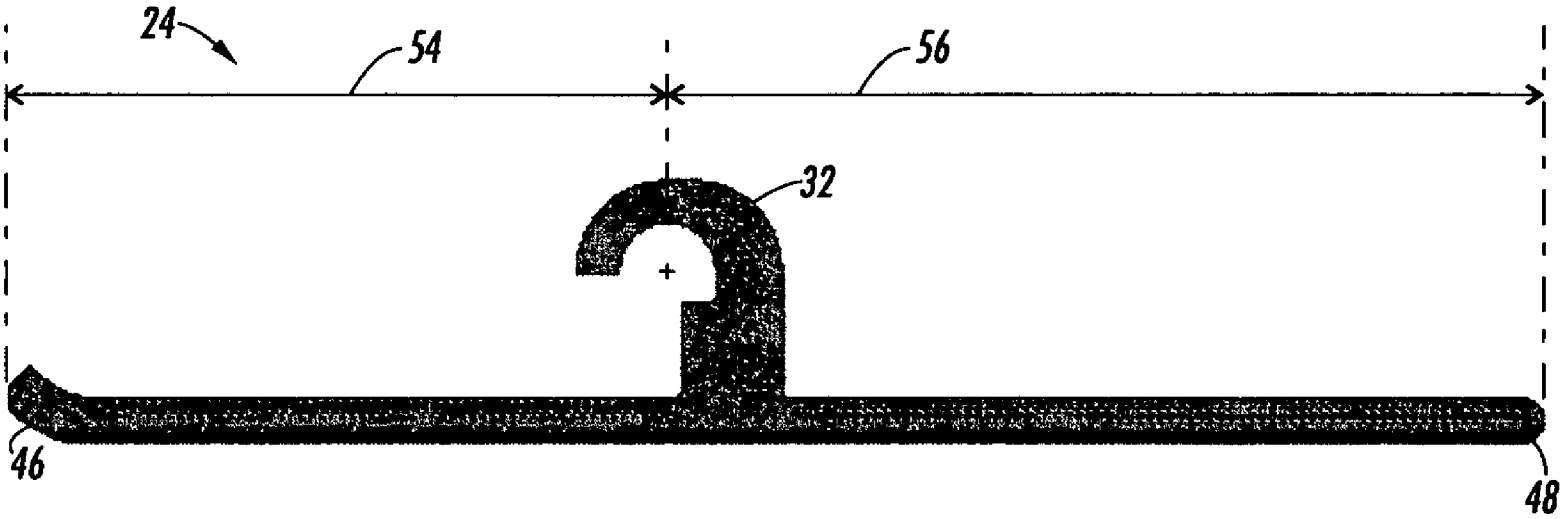
FIG. 3 is side elevation view of the upper heating plate of FIG. 2.

FIG. 3 shows a side elevation view of upper heating plate 24. The hook 32 can be made integral to the upper heating plate 24 by making the upper heating plate 24 out of an extrusion of metal.

The upper heating plate 24 includes an entry end 46 which the print media 30 passes by first when being fed between the upper and lower heating plates 24, 26. The upper heating plate also includes an exit end 48 which the print media 30 passes by last before being fed into the transfix nip 51 formed by the transfix roller 52 and the print drum 50 (see FIG. 5).

The hook 32 can be positioned on the upper heating plate 24 closer to the entry end 46 than the exit end 48. This is illustrated in FIG. 3 by showing that distance 54 from the center of the hook 32 to the entry end 46 is less than the distance 56 from the center of the hook 32 to the exit end 48. When the hook 32 is positioned in this manner, the entry end 46 is lifted farther away from the print media 30 than is the exit end 48 when the lever arm bracket 34 lifts the hook 32.

FIG. 5 shows a side elevation view of the preheater 20 in a printer 22 with print media 30 being fed between the upper and lower heating plates 24, 26 of the preheater 20 and then being fed to the transfix nip 51 formed by the transfix roller 52 and the print drum 50. The upper heating plate 24 is shown lifted away from the print media 30. Here a print media entrance gap 57 between the upper and lower heating plates 24, 26 is shown to be larger than a print media exit gap 59 between the two plates 24, 26. The print media 30 is fed between the upper lower plates 24, 26 at the print media entrance gap 57 with the print media 30 exiting the preheater 20 and the upper and lower heating plates 24, 26 at the print media exit gap 59.

The print media exit gap 59 should be sized to relieve enough pressure from the upper heating plate 24 on the print media 30 to eliminate smudging of the ink on duplex prints. But the exit gap 59 should also be sized to provide adequate guidance of the print media 30 to the next nip without stubbing or damaging the print media 30. It was found through experimentation that for the poor conditions of high humidity and low stiffness media, a media exit gap 59 of about 0.07 inches or less produces desirable results.

Figure 4:
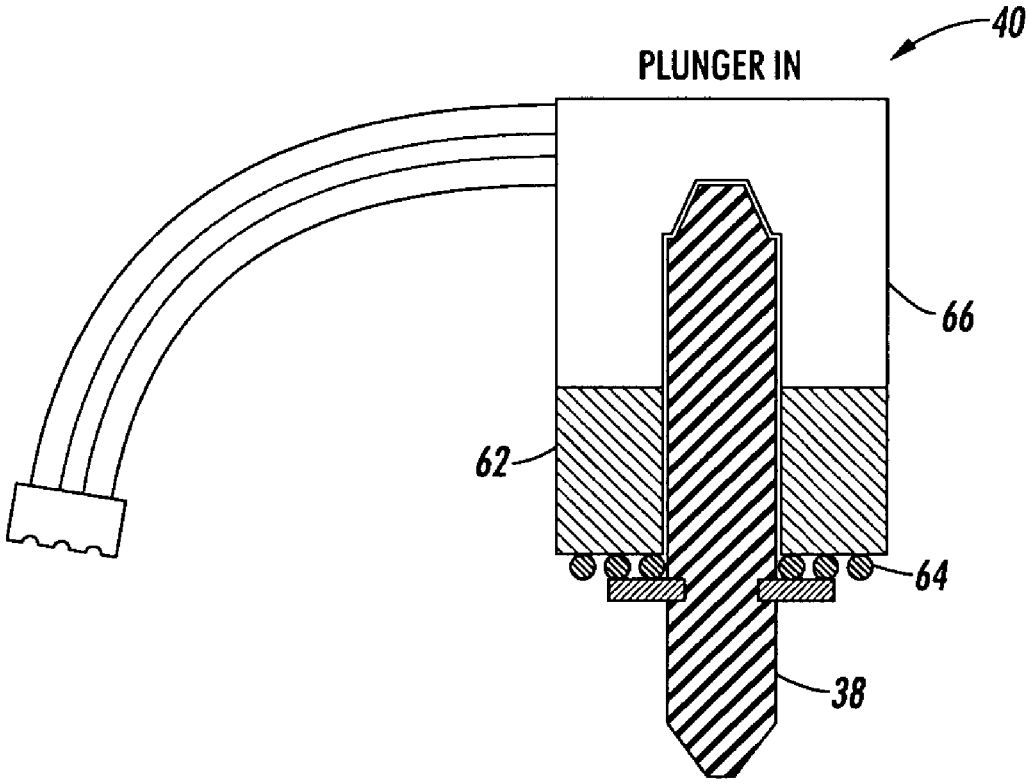
FIG. 4 is a vertical cross-sectional view of the solenoid of the print media preheating system of FIG. 1.

FIG. 4 shows a vertically oriented cross-sectional view of the solenoid 40 used to contact and move the lever arm bracket 24 (see FIGS. 1-2). The solenoid 40 is a keep-type solenoid that includes magnet 62, plunger 38 and spring 64. In a keep-type solenoid 40, the spring 64 biases the plunger 38 to remain in an extended position (as shown in FIG. 1). The magnet 62 overcomes the bias of spring 64 to retain the plunger 38 within the solenoid body 66 as shown here in FIG. 4. The magnet 62 allows the plunger 38 to be retained in a retracted position without having to apply a continuous current to the solenoid. Instead, the plunger 38 remains retracted until a reverse current signal is applied to the solenoid 40. A current can then be applied to overcome the biasing force of the spring 64 to retract the plunger 38 back into the solenoid 40.

The ability to control the plunger 38 position without a continuous current allows for more flexibility. The heating plates 24, 26 can be continuously closed together or continuously opened apart without overheating the solenoid 40 throughout the life of a printer 22.

Referring to FIGS. 1 and 5, a method use of the preheater 20 will now be described. After the printer 22 prints on the simplex side of the print media 30, the print media 30 is fed back again to the preheater 20 with the print media positioned to have its duplex side printed.

The print media 30 is fed into the preheater 20 between the upper and lower heating plates 24, 26 such that the pre-printed simplex side of the print media 30 faces the upper heating plate 24. The temperature of the upper and lower heating plates 24, 26 is set by the preheater 20 to preheat the print media 30 before feeding the print media 30 to the transfix nip 51. With the preheater 20 described, the temperature of the upper and lower heating plates 24, 26 can be set to a temperature that is higher than a smudging temperature of the ink printed on the simplex side of the print media 30.

The upper heating plate 24 is lifted away from the print media 30 to relieve pressure from the upper heating plate 24 on the print media 30 resulting in reduced smudging of the ink printed on the simplex side of the print media facing the upper heating plate 24. The upper heating plate 24 can be lifted away from the print media by levering the upper plate 24 using lever such as lever arm bracket 34.

Levering the upper plate 24 with lever arm bracket 34 can be done by operatively connecting a plunger 38 from solenoid 40. The solenoid 40 can be activated to release the plunger 38 by a reverse current.

Lifting the upper heating plate 24 away from the print media 30 can include creating print media entrance gap 57 between the upper and lower heating plates 24, 26 that is greater than print media exit gap 59 between the upper and lower heating plates 24, 26.

Further, using the preheater 20 can include lowering the upper heating plate 24 back down to the lower heating plate 26 and then feeding simplex print media 30 between the upper and lower heating plates for preheating the print media 30 for printing on a single side of the print media 30.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A print media preheater, comprising:

an upper heating plate arranged to heat a previously printed side of a print media;

a lower heating plate fixed in position and arranged to heat a side of the print media opposite the previously printed side;

a hook arranged on an upper surface of the upper heating plate;

a pivot connection; and a lever pivotably connected to the pivot connection, pivotably connected to the hook, and structured to relieve a pressure exerted on the print media by the upper heating plate by lifting the upper heating plate;

in which:

the hook is arranged on the upper surface of the upper heating plate closer to an entry end of the upper heating plate than to an exit end of the upper heating plate;

the lever and hook are positioned to lift the upper heating plate such that a print media entrance gap between the upper heating plate and the lower plate is greater than a print media exit gap between the upper heating plate and a lower plate; the lever is disposed to rotate about the pivot connection on a first axis; the hook is disposed to rotate about the lever on a second axis; and the first axis is different from the second axis.

2. The print media preheater of claim 1, further comprising a solenoid that includes a plunger arranged to contact and move the lever to cause the lever to lift the upper heating plate responsive to a signal to the solenoid.

3. The print media preheater of claim 2, in which the solenoid is a keep type solenoid including a magnet arranged to retain the plunger without application of a continuous current.

4. The print media preheater of claim 2, in which the solenoid includes a spring positioned to bias the plunger to extend from the solenoid.

5. The print media preheater of claim 1, in which the print media exit gap is less than about 0.07 inches.

6. The print media preheater of claim 1, in which the preheater is further adapted to heat the upper heating plate to a temperature above a smudging temperature of an ink.

7. The print media preheater of claim 1, in which the lever is comprised of a material including a glass and mineral filled plastic having low deflection and low creep characteristics at a temperature of about 110° C.

8. The print media preheater of claim 1, in which the hook is disposed on the upper surface of the upper heating plate between the entry end of the upper heating plate and the exit end of the upper heating plate.

9. The print media preheater of claim 1, in which the upper heating plate is configured to rotate about the lever at the hook.

10. The print media preheater of claim 9, in which when the upper heating plate is lifted by the lever an angle between the hook and the lever is different from when the upper heating plate is not lifted by the lever.

11. The print media preheater of claim 1, in which the pivot connection, the lever, and the hook are disposed such that as the lever rotates about the pivot connection, the hook rotates about the lever.

* * * * *